United States Patent [19]

Moody et al.

[11] 4,025,318

[45] May 24, 1977

[54] GASIFICATION OF HYDROCARBON FEEDSTOCKS

[75] Inventors: Burton E. Moody; John E. Schuster, both of Allentown, Pa.

[73] Assignee: Air Products and Chemicals, Inc., Allentown, Pa.

[22] Filed: Oct. 5, 1976

[21] Appl. No.: 729,740

Related U.S. Application Data

[63] Continuation-in-part of Ser. No. 614,408, Sept. 18, 1975, abandoned.

[52] U.S. Cl. ..... 48/213; 48/197 R; 48/211; 423/650

[51] Int. Cl.[2] ..... C01B 2/16

[58] Field of Search ..... 48/213, 211, 197 R, 48/199 R; 252/373; 260/683.9, 449 M; 423/650; 208/362

[56] References Cited

UNITED STATES PATENTS

| | | | |
|---|---|---|---|
| 3,124,436 | 3/1964 | Dent et al. | 48/213 |
| 3,178,272 | 4/1965 | Dent et al. | 48/213 |
| 3,202,603 | 8/1965 | Keith et al. | 48/213 |
| 3,387,942 | 6/1968 | Habermehl et al. | 252/373 |
| 3,870,481 | 3/1975 | Hegarty | 48/213 |
| 3,891,404 | 6/1975 | Weil et al. | 48/213 |

*Primary Examiner*—Robert L. Lindsay, Jr.
*Assistant Examiner*—George C. Yeung
*Attorney, Agent, or Firm*—James C. Simmons; Barry Moyerman

[57] ABSTRACT

Hydrocarbon feedstock is first vaporized in the presence of hydrogen and then the vaporized hydrocarbon feedstock together with excess hydrogen, is gasified to form an effluent gas consisting essentially of methane and aromatic hydrocarbons together with hydrogen and minor amounts of hydrogen sulfide. The process is suitable for the production of a pipeline gas having a heating value of approximately 1,000 BTU/SCF by further processing the effluent, after separation of the aromatic fraction and hydrogen sulfide from the gasifier effluent; the effluent is subject to cryogenic separation of the hydrogen with the hydrogen being recycled to the gasification step and the methane being discharged into a product pipeline. The overall process contemplates revaporization of the aromatic fraction separated from the effluent and regasification to extinction of this fraction. Preferred feedstocks are crude oil, bitumen produced from tar sands, shale oil, liquid volatiles resulting from coking of coal, liquefied coal resulting from solvating coal with a solvent and hydrogen, aromatic hydrocarbons, naphtha, gas oils, crude oil distillates, and crude oil residues.

It is contemplated that the gasifier effluent could be used as a feedstream for the production of a hydrogen-carbon monoxide synthesis gas, hydrogen, carbon monoxide or as a source of fuel to be burned in place of oil or other liquid hydrocarbons.

18 Claims, 4 Drawing Figures

GASIFICATION OF HYDROCARBON FEEDSTOCKS

CROSS-REFERENCE TO RELATED APPLICATION

This application is a continuation-in-part of application Ser. No. 614,408 filed Sept. 18, 1975, now abandoned.

BACKGROUND OF THE INVENTION

1. Field of the Invention

This invention pertains to processes for gasifying hydrocarbon feedstocks to form an effluent consisting essentially of methane and an aromatic fraction which is substantially benzene, and to the production of synthetic natural gas (methane) by the gasification of hydrocarbon feedstocks. Hydrocarbon feedstocks are vaporized in the presence of hydrogen and then, with an excess of hydrogen, are reacted at high temperature to produce an effluent gas containing essentially methane, aromatics, acid gases such as hydrogen sulfide and excess hydrogen. In one aspect of the invention, the effluent from the gasification step is then further processed by condensing and/or absorbing out the aromatic fraction, removing the acid gases and finally, separating the hydrogen from the methane to produce a synthetic natural gas (SNG) having a heating value of approximately 1,000 BTU/SCF. The resulting synthetic natural gas can be discharged into a storage receptacle or put into a pipeline for use by residential communities or industrial concerns. The aromatics removed from the gasifier effluent are revaporized and recycled to the gasifier for reaction to extinction. The acid gases containing mainly hydrogen sulfide are reacted to produce elemental sulfur.

The gasifier effluent is suitable as a plant fuel or feedstream for further processing into a hydrogen-carbon monoxide synthesis gas or hydrogen gas.

2. Prior Art

Gasification of hydrocarbon feedstocks, mainly crude oil and crude oil fractions, to produce a synthetic pipeline gas either rich in hydrogen or rich in methane is shown by many processes in the prior art. These processes are extensively discussed in the specification of U.S. Pat. No. 3,870,481 which is owned by the assignee of this application. The specification of U.S. Pat. No. 3,870,481 is incorporated by reference herein.

U.S. Pat. No. 3,870,481 discloses and claims a process for producing synthetic natural gas from crude oil which encompasses vaporizing a substantial portion of the crude oil at a temperature of between 600° and 1,000° F, thereafter introducing the vaporized crude oil and hydrogen gas into a gasification vessel maintained at a temperature in excess of 1,000° F wherein the feedstream is gasified producing an effluent consisting essentially of hydrogen, hydrogen sulfide, methane, ethane and residual aromatic hydrocarbons; thereafter cooling the effluent gas stream to ambient temperature and recovering the waste heat, drying the effluent and removing the hydrogen sulfide and residual aromatics from the effluent, cryogenically separating the methane and the ethane from the hydrogen and thereafter reacting the ethane with steam to produce addtional methane and carbon dioxide and removing the carbon dioxide from the stream. The two methane streams are combined and discharged into a product pipeline or storage vessel.

SUMMARY OF THE INVENTION

After developing the process embodied in U.S. Pat. No. 3,870,481, new discoveries were made and the process of the present invention devised wherein excess hydrogen is used and the temperature of the gasifier is maintained at a temperture level in excess of 1550° F, to gasify the aromatics in the feedstocks and to suppress the formation of ethane, thus increasing the methane content of the gasifier effluent. Thus a process had been developed wherein heavy crude oils and other hydrocarbon feedstocks could be successfully gasified and the gasifier effluent could be processed to produce a synthetic natural gas. It was also discovered that if the aromatics removed from the gasifier effluent were revaporized and recycled to the gasifier, these aromatics could be gasifier to methane and the net production of aromatics could be reduced or eliminated.

One typical hydrocarbon feedstock for the process could have the following characteristics:

1. A gravity of 10° API.
2. A metal content of 350 ppm of vanadium.
3. A sulfur content of 3 %.

It is contemplated that hydrocarbon feedstocks for the process of the present invention will come from heavy crude oils which are now shut-in because of limited market demand due to their inherent characteristics, bitumen produced from tar sands, shale oil, liquids produced from coal using new liquefaction and hydrogenation technologies now under development, volatiles from the coking of coal, aromatic hydrocarbons, naphtha, gas oils, crude oil distillates and crude oil residues. In view of the current world situation involving natural gas shortages and the existence of large reserves of bitumen, the process of the present invention will, in the future, be of increasing importance.

While the process of the present invention is suitable for gasifying conventional crude oils, it is primarlily designed for those types of heavy hydrocarbon feedstocks which must be considered the source of future synthetic natural gas. Crude oils with high metal content, particularly vanadium, are extremely detrimental to catalysts used in conventional oil refineries for manufacturing gasoline. Heavy oils also generate large volumes of residues (bottoms) that become difficult to utilize when a conventional process, depending upon catalytic conversion, is used. Heavy hydrocarbon feedstock processed by thermal rather than catalytic techniques provide overall process economies.

Crude oil is a heterogeneous mixture of hydrocarbon compounds. It was found that the ability to hydrogasify (gasify in the presence of hydrogen) a given oil fraction in a gasifier is affected by the nature of the hydrocarbon compound introduced into the gasifier. It has been discovered that when operating the gasifier at a temperature below 1550° F, at pressures in excess of 75 psig with a gasifier feedstream containing a fraction of heavy polycyclic hydrocarbons (characterized as having a high boiling point and as being highly aromatic), that these fractions tended to pass through the gasifier without substantial gasification (reaction). Furthermore, it was found that the effluent from the gasifer contained these unreacted polycyclic oil compounds and that the recovery of waste heat in a waste heat boiler from the effluent stream of the gasifier was impossible because these polycyclic compounds are tarry in nature and when condensed would foul the surface of the heat exchanger. Thus, quenching of the effluent directly out of the gasifier was required resulting in a loss of overall thermal efficiency.

In order to overcome these problems and provide an improved process it was discovered that by increasing the temperature of the gasifier to a temperature above 1550° F and preferably about 1600° F while maintaining a pressure of 600 psig, that these heavy polycyclic oil compounds could be gasified in the presence of hydrogen (hydrogasified). The gasifier effluent is substantially methane with less than 5 mole percent ethane (gasification reaction below 1500° F produces substantial ethane). Furthermore, it was found that the aromatics in the effluent were free of the heavy tarry polycyclic compounds and consisted of compounds which were mainly benzene. The effluent from the hydrogasification reactor (hydrogasifier) was thus suitable for waste heat recovery since this could be accomplished without fouling of the waste heat boiler surfaces.

With the process of the present invention, aromatic compounds in the gasifier effluent can be removed and recycled back to the gasifier as a vapor for conversion to methane or used in other process schemes as needed. By controlling the recycle stream, the process can be run with no net production of aromatic compounds.

The process of the invention yields an effluent without formation of substantial amounts of carbon in the process reactor by maintaining a sufficiently high concentration of unreacted hydrogen in gasifier effluent. It was found necessary to maintain a minimum unreacted hydrogen content in the effluent gas at the desired operating conditions of about 65 % by volume in order to prevent substantial carbon formation in the gasifier.

The principal advantage of our discovery and process resides in the method of gasifying heavy hydrocarbon feedstocks containing heavy polycyclic oil compounds to produce essentially methane and light aromatics such as benzene and to recycle these aromatics to extinction to produce only methane, if desired. This makes possible the use of hydrocarbon feedstocks which exist in large volumes in the world but which were not heretofore considered suitable for use in this manner.

Furthermore, there is shown a one-step method for producing substantially methane from a hydrocarbon feedstream wherein waste heat boilers can be used for heat recovery when heavy polycyclic compounds are contained in the feedstream.

Thus, in accord with another aspect of the present invention, a process for producing synthetic natural gas having a heating value of approximately 1,000 BTU/SCF from hydrocarbon feedstocks can be achieved by vaporizing the hydrocarbon feedstock in the presence of hydrogen and then injecting the vaporized hydrocarbon feedstock together with excess hydrogen into a gas recycle hydrogenator (GRH) operated at a minimum pressure of 75 psig such as disclosed by the British Gas Corporation (formerly British Gas Council) in U.S. Pat. No. 3,363,024. The GRH reactor is an adiabatic open vessel reactor with a concentric draft tube into which the hydrogen/oil vapor is injected. Gas recirculation within the reactor is caused by jetting the reactants into the draft tube, whereby the gases within the reactor are entrained with the newly injected reactants. Operating the reactor at a minimum pressure of 75 psig and at a temperature in excess of 1550° F in combination with the high recirculation rate insures that the injected vapor is brought to reaction temperature in a matter of milliseconds. The hydrogen-/oil vapor mixture reacts to produce a gasifier effluent consisting essentially of methane, aromatics and acid gases together with a large amount (approximately 65 %) of free hydrogen. After removal from the reactor, the hot effluent can be cooled to ambient with heat recovery for use elsewhere in the process. Cooling of the effluent can be accomplished by any known methods including a combination quench and cooling. During heat recovery the condensible aromatics are condensed and removed from the effluent stream. Subsequently, the acid gases and noncondensible aromatic fraction are removed from the effluent thus producing stream consisting essentially of methane and hydrogen. The methane is separated from the hydrogen by cryogenic techniques and is ready for use as a synthetic natural gas. The hydrogen is recycled to the gasifier for use in gasifying the hydrocarbon feedstocks.

Another suitable reactor is the Fluidized Bed Hydrogenator (FBH) developed by the British Gas Coropoation and disclosed in U.S. Pat. No. 3,124,436. This reactor operates on a similar principle as the GRH except that hot carbon particles are recirculated with the gas. The hot recirculating carbon particles would serve to supply heat to the feedstream which would be introduced into the reactor, operated at a pressure in excess of 300 psig as specified by patentees and at a temperature in excess of 1550° F in accord with our invention, as hydrocarbon-hydrogen vapor.

The aromatic condensate is composed primarily of benzene and naphthalene with small quantities of heavier compounds. In one aspect of the invention the condensate is revaporized and returned to the reactor.

Therefore, it is the primary object of this invention to provide a process for gasifying a hydrocarbon feedstock to produce a gasifier effluent consisting essentially of methane and aromatic hyrodcarbons.

It is another object of the present invention to provide a method of producing synthetic natural gas having a heating value of about 1,000 BTU/SCF.

It is still another object of this invention to provide a method of gasifying a hydrocarbon feedstock without forming large amounts of ethane.

It is yet another object of the invention to provide a process for gasifying hydrocarbon feedstocks to produce an effluent suitable for plant fuel or as a feedstream for use in the manufacture of a hydrogen/carbon monoxide synthesis gas, hydrogen, or carbon monoxide.

DETAILED DESCRIPTION OF THE PREFERRED EMBODIMENT

Figure 1:
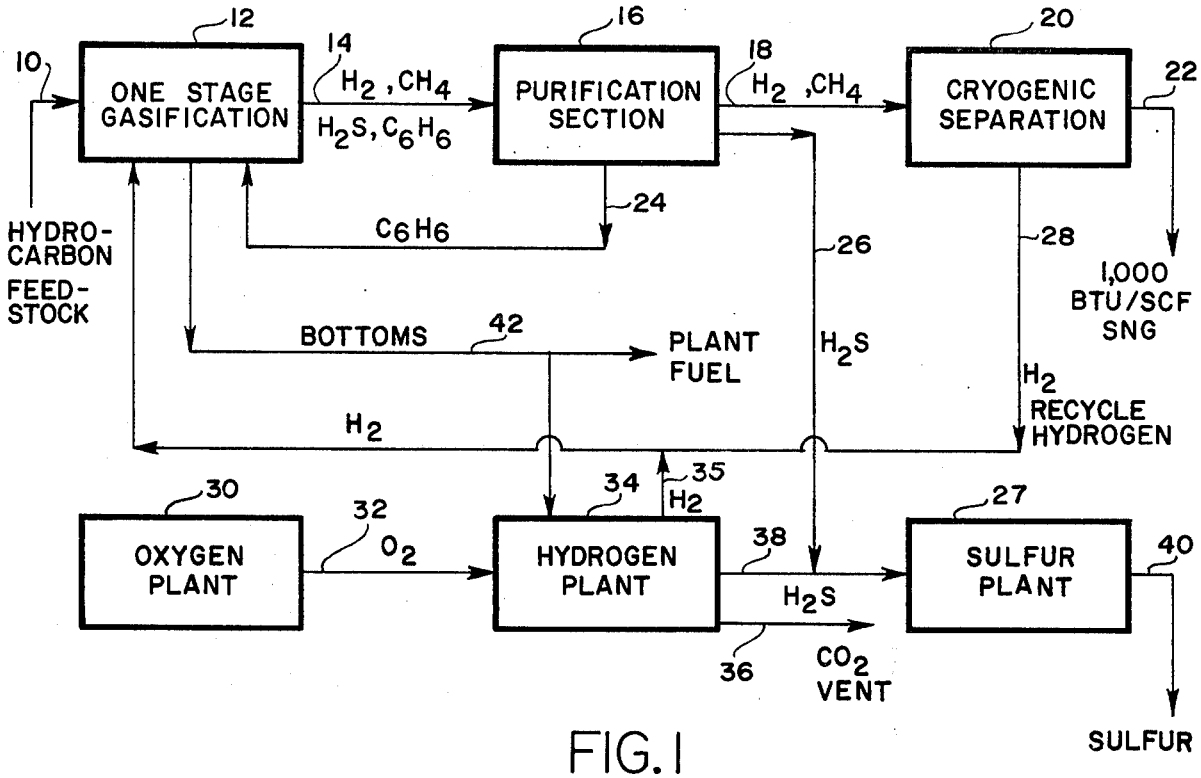
FIG. 1 is a block diagram illustrating the process of gasifying hydrocarbon feedstocks according to the present invention.

Referring to FIG. 1, the overall process according to the invention, is shown in block form. In FIG. 1, arrow 10 includes the hydrocarbon feedstock which is selected from those materials such as crude oil, bitumen produced from tar sands, shale oil, liquid volatiles resulting from coking of coal, liquefied coal resulting from solvating coal with a solvent and hydrogen, aromatic hydrocarbons, naphtha, gas oils, curde oil distillates and crude oil residues. In the one stage gasification step 12 the hydorcarbon feedstock is preheated to about 700° F and vaporized in the presence of hydrogen which is initially heated to a temperature in excess of 750° F in accord with the vaporization technique disclosed in U.S. Pat. No. 3,870,481. Other vaporization methods can be used so long as such methods provide a vaporized hydrocarbon feed. The vaporized hydrocarbon and excess hydrogen feed are introduced into the single-stage gaisfier. As set out above, the preferred gasification vessle is that disclosed in U.S. Pat. No. 3,363,024 and commonly referred to as a gas recycle hydrogenator (GRH).

However, any gasification vessel is suitable so long as the feedstream is heated rapidily (less than one second) to a temperature in excess of 1550° and the feedstream is allowed to dwell at temperature for a long enough time period (greater than one second) so that the overall gasifier effluent consists essentially of methane, aromatic compounds (mostly benzene), unreacted hyrodgen in the amount of at least 40% by volume of the effluent together with minor amounts of ethane (less than 5 mole percent), ethane compounds, ethylene, propane, propylene and hydrogen sulfide if sulpher is present in the feedstock.

The hydrocarbon feedstock and hydrogen are injected into gasifier, recirculated, and reacted to form an effluent stream shown by arrow 14 consisting essentially of methane, aromatics, hydrogen sulfide and excess hydrogen. The effluent is cooled to ambient temperature in the purification section 16 thus condensing out the condensible aromatics which are primarily benzene and naphthalene. Removal of the residual aromatics and hydrogen sulfide is accomplished by a purfication process such as disclosed in U.S. Pat. No. 2,863,527. The process disclosed in this patent is known commercially as the Rectisol Process marketed by Lurgi Mineralol Technic GmbH, Frankfort Am Main, West Germany.

After the gasifier effluent 14 passes through the purfication section 16, a product stream designated by arrow 18, containing essentially hydrogen and methane, is subjected to a cryogenic separation designated by block 20. In the cryogenic separator, the hydrogen is separated from the methane yielding a synthetic natural gas stream consisting essentially of methane (designated by arrow 22). While cryogenic separation of the hydrogen is preferred, other techniques for hydrogen removal can be used. Among these are pressure swing absorption and gas diffusion through a membrane. The synthetic natural gas stream consists essentially of methane with minor amounts, e.g. less than 2% of hydrogen and ethane.

The condensible aromatics consisting essentially of benzene and napthalene (designated by arrow 24) are recycled to the vaporizer for revaporization and gasification. The condensible aromatics are continuously recycled in this manner until extinguished, thereby eliminating the production of by-products which may be undesirable or uneconomical to produce.

The hydorgen sulfide separated out in the purification section and designated by arrow 26 is conducted to a sulfur plant which embodies the Claus Process as is well known in the art. The Claus Process is discussed in detail in an article by V. W. Gamson and R. H. Elkins entitled "Sulfur From Hydrogen Sulfide" which appeared in Chemical Engineering Process, Volume 49,number 4, April, 1953 beginning at page 203.

Hydrogen represented by arrow 28 removed from the cryogenic separation unit is recycled to the gasification step for use in vaporization of the hydrocarbon feedstock and as excess hydrogen to be added to the gasifier.

Included in the overall process scheme is an oxygen plant 30 which produces oxygen designated by arrow 32 for use in a hydrogen plant 34 to produce hydrogen designated by arrow 35 for use in the vaporization and gasification of the hydrocarbon feedstock. The hydrogen plant produces hydrogen by the well known partial oxidation process. The balance of the hydrogen plant 34 includes waste heat revovery systems, water gas shift, acid gas removal and methanation systems to produce high purity hydrogen by the reaction of C0 and steam and subsequent removal of the hydrogen sulfide and $C0_2$. $C0_2$ from the hydrogen plant 34 is vented through a conduit designated by arrow 36 and the hydrogen passed to the process stream as designated by arrow 35. Hydrogen sulfide produced in the hydrogen plant 34 and designated by arrow 38 is conducted to the sulfur plant where elemental sulfur designated by arrow 40 is produced.

Figure 2:
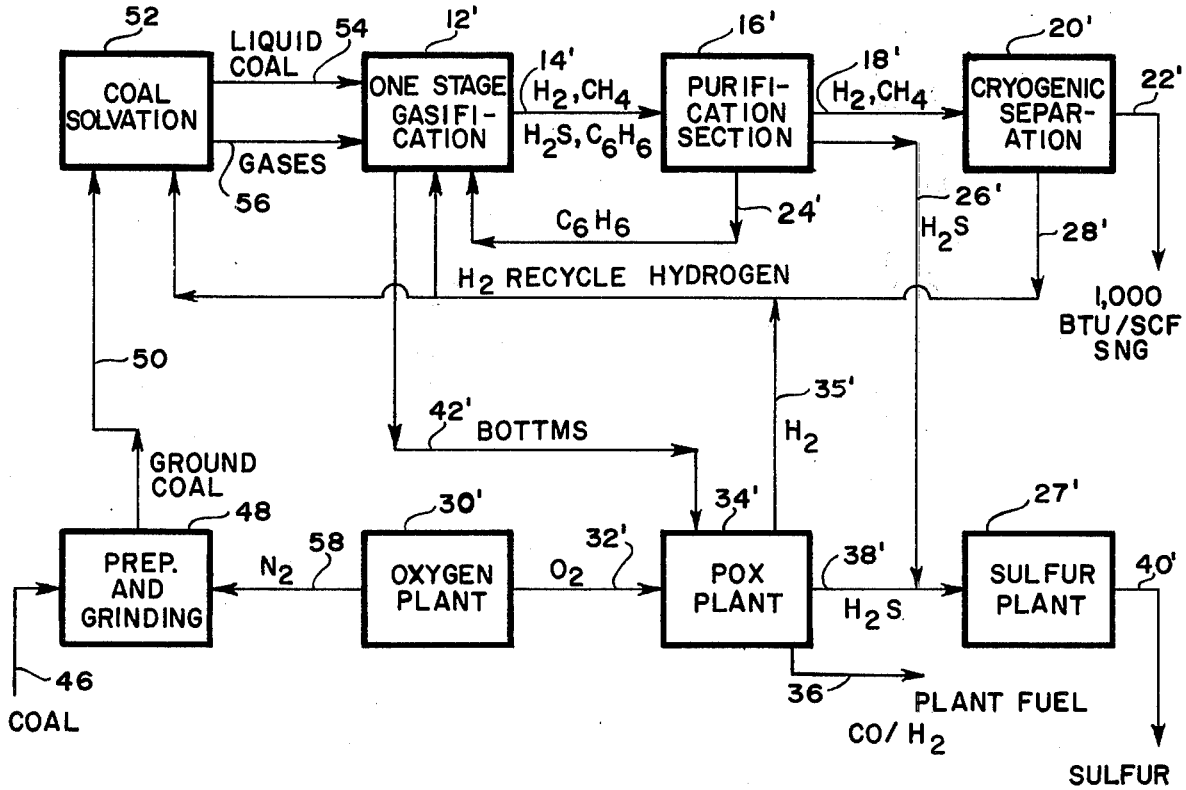
FIG. 2 is a block diagram illustrating an alternate process according to the invention utilizing liquefied coal, prepared as part of the process, as a feedstock.

FIG. 2 is a schematic of the process of FIG. 1 wherein the process includes the additional steps of preparation and grinding followed by solvating coal to produce a liquefied coal for introduction into the gasifier for gasification to produce a synthetic natural gas. In the process of FIG. 2 there is included a source of coal designated by arrow 46 which is introduced to a preparation and grinding facility designated by block 48 wherein the coal is finely ground and given an initial separation to remove unwanted gangue materials. The ground coal designated by arrow 50 is introduced to a coal solvation process wherein the coal is liquefied by reacting with a solvent and hydrogen. The coal solvation step is designated as 52. The solvation process can be chosen from any of those available or under development such as the P and M Process developed by Pittsburgh and Midway Mining Company and the Consol CSF Process developed by the Consolidation Coal Company. The liquefied coal designated by arrow 54 together with hydrogen and other gases generated in the initial solvation step designated by arrow 56 are introduced into the vaporizer and the process continues such as described in relation to FIG. 1.

In the coal solvation process, nitrogen from the oxygen plant 30' designated by arrow 58 can be used as an inerting atmosphere in preparing the coal for solvation.

In the process of FIG. 2 it is contemplated that substantially all of the ash from the coal will be removed in the coal solvation step and will not affect the overall process.

Figure 3:
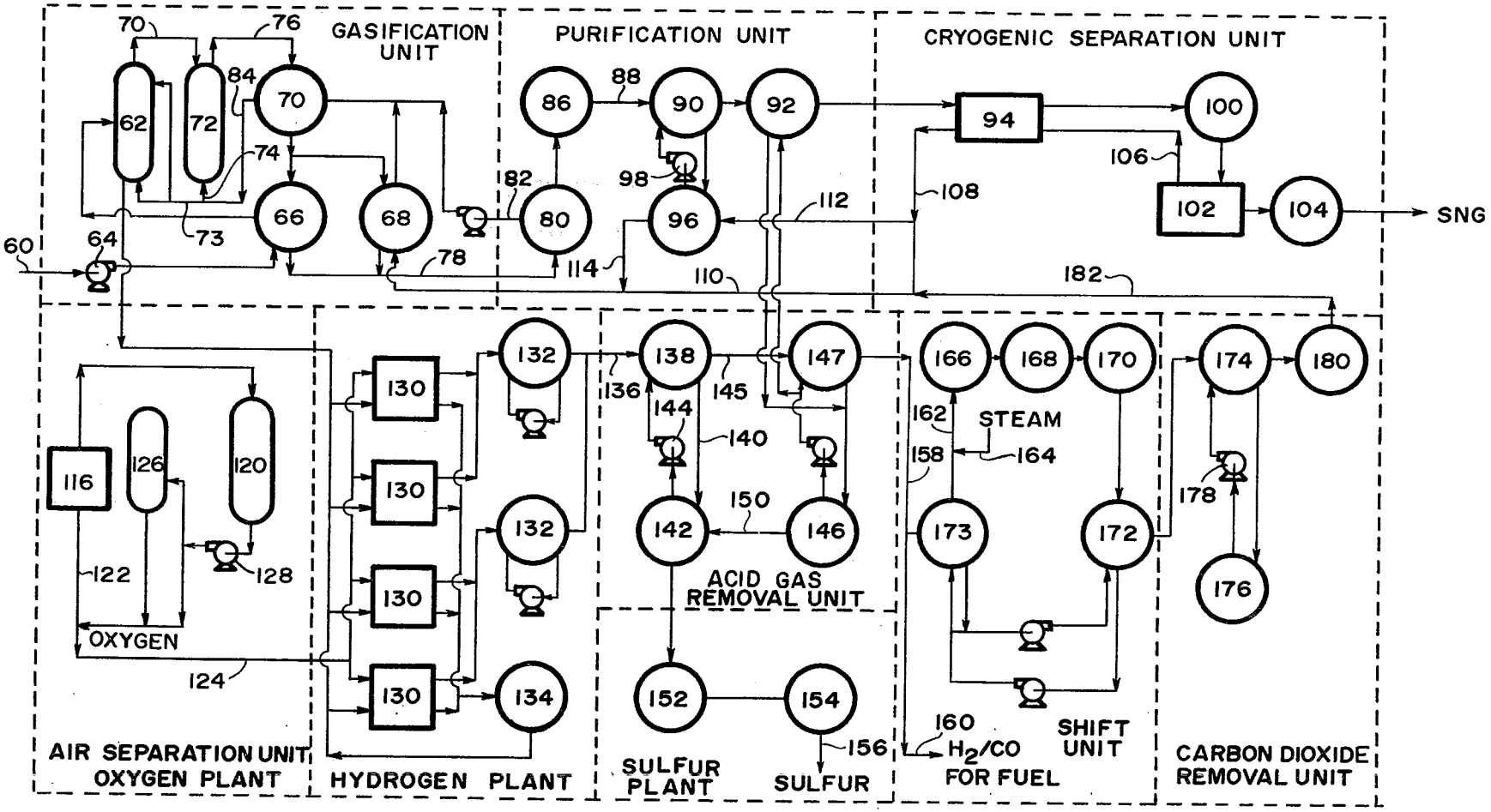
FIG. 3 is a schematic flow diagram of a plant embodying the process of the invention for producing synthetic natural gas.

FIG. 3 is a schematic flow sheet of a plant which would be suitable for producing 150,000,000 standard cubic feet per day of synthetic natural gas from approximately 30,000 barrels per day of a heavy crude oil. The product of the plant described in FIG. 3 is a synthetic natural gas containing essentially methane with minor amounts of hydrogen and ethane having a heating value of about 1,000 BTU/SCF and is delivered at 1,000 psig pressure. The plant features recovering sulfur as a by-product. Such a plant would have an expected thermal efficiency of about 78% and includes six major processing sections namely gasification, purification (comprising aromatic separation, acid gas removal, shift and carbon dioxide removal), cryogenic separation, oxygen supply, hydrogen supply and sulfur recovery. Such a plant is designed to be self-sufficient by incorporating a combined cycle power generation system and all required off-site areas.

When in operation, a hydrocarbon feedstock such as heavy crude oil, hydrogen and recycled aromatic condensate are fed to the gasification section to produce a 600 psig gasifier effluent (containing aromatic liquid condensate) and a residual oil fraction.

In the schematic diagram of FIG. 3 the process flows throughout the system are designated by the arrows shown.

The hydrocarbon feed 60 is introduced to the vaporizer 63 through suitable intermediate conduits (designated by the arrows) by means of pump 64 and oil preheater 66 wherein the oil is raised to a temperature of aboout 700° F. Hydrogen and recycled aromatics (arrow 73) are introduced to the vaporizer 62 through hydrogen perheater 68 and waste heat recovery boiler 70 wherein the temperature of the hydrogen is raised to a level in excess of 750° F. In one type of vaporizer hot hydrogen is sparged into the hydrocarbon feedstock beneath the liquid level in the vaporizer. The vaporized hydrocarbon feedstock and excess hydrogen then flows as indicated by arrow 70 to the gas recycle hydrogenator (GRH) 72 wherein the gasification of the hydrocarbon feedstock takes place. Hydrogen and recycled aromatics introduced through a conduit designated by arrow 74 are used to control temperature in the GRH 72. As described previously, the GRH reactor 72 is an adiabatic open vessel reactor with a concentric draft tube into which the hydrogen/hydrocarbon vapor is injected. Gas recirculation with the reactor is caused by jetting the reactants into the draft tube whereby the gases within the reactor are entrained in the reactant stream. Recirculation rates within the reactor of apporximately 10 to 20 times the injected vapor volume may be obtained using this device. The high recirculation rate of hot gases, combined with the temperature of greater than 1550° F inthe GRH assures that the injected vapor is brought to reaction temperatures in a matter of milliseconds. The hydrogen-feedstock vapor mixture reacts to produce primarily methane, aromatics, and hydrogen sulfide. With the hydrogen/oil vapor inlet temperature fixed, the temperature within the GRH is controlled by a gas recycle stream consisting of hydrogen and/or recycle aromatics which prevents overheating of the GRH reactor due to the exothermic hydrogenation reactions. Approximately 65% of the effluent from the GRH reactor remains as free hydrogen and this hydrogen is recovered subsequently and recirculated back to the vaporizer. The average residence time for the feedstock in the GRH reactor is 5 to 15 seconds. The hot effluent gases from the GRH reactor designated by arrow 76 are cooled to ambient by passing through a waste heat recovery boiler 70 oil preheater 66 and conduit 78 to the purification unit where the condensed aromatic fraction is recovered in the aromatic separator 80. The condensed aromatics are removed from separator 80 by conduit 82 mixed with hydrogen from preheater 68 further preheated by passing through waste heat recovery boiler 70 and introduced to the GRH 72 and/or vaporizer 62 by means of conduit 84. The gasifier effluent after removal of the condensible aromatics is compressed to about 750 psig in recycle compressor 86 to permit further processing and recycling of the hydrogen. The effluent from recycle compressor 86 consists primarily of hydrogen, methane, ethane, and hydrogen sulfide saturated with benzene. The effluent designated by arrow 88 is scrubbed with a non-volatile oil to remove residual benzene in oil absorber 90 and then scrubbed with a 22% diethanolamine solution in a packed toweer 92. The diethanolamine (DEA) is regenerated in the acid gas removal system of the hydrogen supply section. The gasifier effluent thus treated leaves the DEA column at about 120° F and is cooled to approximately 40° F in precooler 94. The oil used to remove benzene is stripped of the benzene with a portion of recycled hydrogen, as will subsequently be discussed, at about 175 ° F and 700 psig in oil stripper 96. The oil is then cooled to about 100° F and recirculated by means of pump 98 to the oil scrub column 90. The gasifier effluent precooled to about 40° F in precooler 94 and containing essentially hydrogen and methane is passed through a dryer 100 to remove water and prevent freeze-out in the cryogenic separation unit 102. In the cryogenic separation unit 102 the hydrogen is separated from the synthetic natural gas by cooling the effluent to a temperature of about −237° F to condense the SNG. Refrigeration is supplied by flashing the product to relatively low pressures and rewarming the recycle and product streams against the feed. The SNG product is recompressed in product compressor 104 to the desired product pressure and conducted to the point of use, e.g. pipeline or storage.

The separated hydrogen designated by arrow 106 is conducted through precooler 94 back to the gasification section of the process.

The recycled hydrogen is conducted back to the gasification unit through conduits designated by arrows 106, 108, 110 to the hydrogen preheater. Portions of the recycled hydrogen can be withdrawn, for example, by a conduit designated as arrow 112 and used to remove the benzene from the oil in oil stripper 96. The recovered benzene and hydrogen from oil stripper 96 is returned to the recycle stream by a conduit 114.

In addition to the gasification unit, the necessary support systems are also shown in FIG. 3. The first of such systems in an air separation unit generally encompassing an air plant 116 wherein air is liquefied and separated into nitrogen and oxygen. A portion of the oxygen product is liquefied and taken by a suitable conduit to a storage vessel 120. Gaseous oxygen is recovered from the air plant 116 and introduced through suitable conduits designated 112, 124 to the hydrogen plant. Gaseous oxygen can be stored in a suitable vessel 126 and additional oxygen added from the liquefied storage vessel 120 through suitable heaters and pumps such as 128. Gaseous oxygen is then fed through conduit 124 to a plurality of reactors 130 wherein the oxygen and residual oil from vaporizer 62 are reacted with steam at about 800 psig and 2,600° F to produce a crude synthesis gas. Each reactor, commonly referred to as a partial oxidation or POX reactor produces a crude synthesis gas. The reactor effluent is cooled in an adjacent waste heat boiler (not shown) producing 1,300 psig steam. Entrained soot produced in reactors 130 which is about 3 weight percent of the feed oil is removed by water scrubbing in scrubbers 132 and will be recycled to the process. Carbon recycle will take place in a recycle reactor generally designated 134 which is offered commercially by the Shell Oil Company. The water slurry is contacted with vigorous agitation with naphtha in reactor 134 thus extracting the soot from the water phase by retaining the soot in the hydrocarbon phase. The naphtha is then mixed with the feed to the reactors 130 and after stripping the naphtha for recycling the carbon remains as a slurry in the feed oil.

The product of the hydrogen plant which is designated by arrow 136 is a mixture of carbon monoxide and hydrogen with about 6% $C0_2$ and about 1% hydrogen sulfide. The effluent is conducted to a carbonate absorber 138 at about 690 psia where nearly all of the $C0_2$ and $H_2S$ are scrubbed from the gas by a carbonate solution circulating continuously between absorber and regenerator towers. The solution at the bottom of the absorber 138 after reduction of pressure from 690 psia to about 8 psig is conducted by a conduit designated by arrow 140 to a carbonate stripper 142 where steam stripping is carried out at about 240° F thus liberating the acid gas contained in the solution. The hot solution is conducted from the carbonate stripper 142 via pump 144 back to the carbonate absorber 138 to complete the circulating solution circuit. The effluent from the carbonate absorber 138 containing about 0.5% $C0_2$ and $H_2S$ together with the carbon monoxide and hydrogen is air cooled (not shown) and conducted by conduit 145 for further scrubbing by a DEA solution circulating continuously between a DEA absorber 147 and a DEA stripper 146. The bottoms from the stripper 146 are pumped through a heat exchanger (not shown) for cooling to 120° F and returned to absorber 147 to complete the circuit. The DEA regenerator acid off-gas passes through the carbonate regenerator via a conduit designated by arrow 150 and the combined acid gas stream is cooled, compressed and transferred to a reaction furnace 152 and converter 154 for conversion to elemental sulfur which is withdrawn as at arrow 156. The reaction furnace and converter 152, 154 respectively are part of a conventional Claus plant.

The purified hydrogen/C0 gas from the acid gas removal unit is conducted to a shift unit via suitable conduits designated by arrow 158. A portion of the hydrogen/C0 synthesis gas mixture can be withdrawn to use as fuel for running the plant as designated by arrow 160. The hydrogen/C0 mixture introduced to the shift unit is conducted through a conventional shift converter wherein the C0 is converted to hydrogen by the conventional shift reaction. Initially, the $H_2$/C0 syn gas mixture is passed through a saturator wherein the necessaty water vapor is added to the gas. The pH of the water is automatically controlled in the range of 7.5–8.5 to neutralize the effects of corrosion from the carbon dioxide water mixture. The saturator effluent designated by arrow 162 has steam added to it through a conduit designated by arrow 164 as needed to adjust the $H_{20}$/CO ratio for shift. The syn gas is conducted to a high temperature shift converter 166 containing a conventional iron-chrome base material which has been known for many years. From the high temperature shift converter 166, the gases are conducted to a zinc oxide desulfurizer 168 which is used to prevent any traces of sulfur from penetrating to the low temperature shift converter 170 next in the stream. The low temperature shift converter 170 contains a copper based catalyst that will reduce the carbon monoxide level to about 1%. Such catalysts have been known in the art for more than 10 years.

The effluent from the low temperature shift converter is cooled through a suitable cooler 172 and then passes through a carbon dioxide removal unit similar to those previously described in conjunction with the purification and acid gas removal units. The final purification unit consists generally of the same hot carbonate process used in the first acid gas removal unit except there is included, in addition, to the carbonate absorber 174, a carbonate stripper 176, pump 178, and methanator 180. The primary process differences are removal of $C0_2$ only, rather thanthe combination of $C0_2$ and hydrogen sulfide, and addition of a methanator for reduction of carbon oxides to the desired levels in the hydrogen product from the total facility. The $C0_2$ removal unit receives crude hydrogen from the shift unit. In this unit the carbon dioxide will be removed and remaining traces of $C0_2$ and C0 will be methanated.

The effluent from methanator 180 is conducted into the recycle conduit 110 as shown by arrow 182. The foregoing describes a process that will produce a synthetic natural gas having a heating value of approximately 1,000 BTU/SCF in quantities of approximately 150,000,000 standard cubic feet per day.

Several tests were run to verify the expected results of a process built in accordance with the foregoing description.

One method of running rests was in accord with the system described in FIG. 3 of U.S. Pat. No. 3,870,841. An identical test set up was used and the results from running Kuwait topped crude oil and benzene in such a test setup are set forth in Table 1. Kuwait topped crude oil, as received, had the minus 360° F fraction removed prior to running the test.

TABLE 1

| Run No. | Feedstock | $H_2$ Feed Rate (lb/hr) | Feedstock Vapor Rate (lb/hr) | Average Reactor Temp (° F) | Product Composition (Mole %) $CH_4$ | $C_2H_6$ | $C_2H_4$ | $C_6H_6$ | $H_2$ | $N_2$ |
|---|---|---|---|---|---|---|---|---|---|---|
| R3-02A | Benzene | 0.86* | 1.34 | 1598 | 9.45 | 0.33 | 0.01 | 2.46 | 88.0 | 5.92 |
| R3-02 | " | 0.80 | 1.30 | 1644 | 12.01 | 0.21 | 0.01 | 2.04 | 80.2 | 5.71 |
| R3-03A | " | 1.10 | 1.30 | 1649 | 9.26 | 0.20 | 0.11 | 1.52 | 89.2 | 0.016 |
| R3-03B | " | 1.10 | 1.29 | 1708 | 12.18 | 0.095 | 0.006 | 1.11 | 86.6 | 0.016 |
| R3-04 | " | 0.55 | 0.64 | 1648 | 13.09 | 0.11 | 0.004 | 1.03 | 85.7 | 0.04 |
| R3-05 | " | 0.55 | 0.64 | 1700 | 15.01 | 0.063 | 0.002 | 0.714 | 84.2 | 0.04 |
| R3-06 | " | 0.55 | 1.30 | 1680 | 23.00 | 0.21 | 0.016 | 2.61 | 74.1 | 0.03 |
| R3-08A | Kuwait Topped Crude Oil | 1.11 | 5.68 | 1722 | 53.0 | 0.60 | 0.1 | 0 | 44.0 | — |
| R3-08B | " | 1.08 | 3.24 | 1769 | 33.6 | 0.40 | 0.16 | 0.12 | 64.0 | — |
| R8-02 | " | 1.26 | 2.4 | 1620 | 21.2 | 0.82 | 0.05 | 5.0+ | 73.0 | — |

TABLE 1-continued

| Run No. | Feedstock | $H_2$ Feed Rate (lb/hr) | Feedstock Vapor Rate (lb/hr) | Average Reactor Temp (° F) | Product Composition (Mole %) $CH_4$ | $C_2H_6$ | $C_2H_4$ | $C_6H_6$ | $H_2$ | $N_2$ |
|---|---|---|---|---|---|---|---|---|---|---|
| R8-07 | " | 1.28 | 3.38 | 1624 | 31.0 | 0.83 | 0.08 | 0.75++ | 68.0 | — |

Notes
*Calculated from effluent composition and benzene feed
+Benzene and toluene (approximate)
++Benzene and toluene From the foregoing it is obvious that the gasifier operating at a temperature in excess of 1550° and with excess hydrogen is effective to suppress ethane formation and to provide an effluent that is substantially methane and hydrogen.

The benzene runs were accomplished with total vaporization of the benzene hydrocarbon feedstock in the vaporizer before it was injected into the gasifier. The extent of vaporization of the hydrocarbon feedstock will depend upon its compositions. For example, with the topped Kuwait crude oil is used in the tests, the operation was optimized when approximately 75% of the topped crude oil was vaporized. Lighter feedstocks such as naphtha would completely vaporize while the heavy crude oils and heavy crude-like materials such as bitumen produced from tar sands, shale oils, and solvated coal would be partially vaporized at thee process conditions.

Parallel tests were run in pilot plant operated by the British Gas Council at Solihull, England with the GRH operating at elevated temperature and with excess hydrogen using topped Kuwait crude oil as set forth in Table II, and a Monagas crude oil as set forth in Table III. Monagas crude oil is a Venezuelan bitumen believed to be suitable as an alternative feedstock.

TABLE II

VAPORIZER GRH TESTS
(Sparged Vaporizer)
(GRH Operating Temp. 1650° F)

Test Data
Feedstock: Topped Kuwait
Vaporizer Pressure, PSIG: 600

| Run No. | Run Hrs. | Vap. Temp. ° F | GRH Temp. ° F (Av) | Product Comp. Vol. % $CH_4$ | $C_2H_6$ | $H_2$ | Condensate Wt. % GRH Feed (B) |
|---|---|---|---|---|---|---|---|
| H17F | 26.0 | 795 | 1650 | 28 | 1.2 | 70 | 11.5 |
| H18F | 8.5 | 818 | 1650 | 29 | 1.2 | 70 | 10.2 |
| H19F | 41.5 | 817 | 1650 | 31 | 1.3 | 68 | 11.6 |
| H20F | 22.0 | 814 | 1655 | 33 | 1.0 | 67 | 8.6 |
| H21 (A) | 31.0 | 797 | 1640 | 27 | 1.1 | 72 | 24.5 (G)<br>3.0 (N) |
| H22 (A) | 14.5 | 797 | 1650 | 26 | 1.2 | 72 | 22.5 (G)<br>2.0 (N) |
| H23 (A) | 32.8 | 800 | 1650 | 30 | 1.1 | 69 | 29 (G)<br>8.6 (N) |
| H24 (A) | 12.3 | 805 | 1635 | 32 | 1.0 | 67 | 20.1 (G)<br>−2.4 (N) |
| H25 (A) | 10.3 | 812 | 1640 | 35 | 1.5 | 63 | 27.2 (G)<br>8.7 (N) |
| H26 (A) | 5 | 808 | 1597–1651 | 36.3 | 1.4 | 62.3 | — |
| H27 (A) | 17.5 | 806 | 1643 | 34.3 | 1.62 | 64 | 34.1 (G)<br>16.8 (N) |
| H28 (A) | 72 | 804 | 1638 | 32 | 1.5 | 66 | 27.9 (G)<br>5.6 (N) |

(A) Feedstock is 16.3% wt % $C_6H_6$, 83.7% wt % Topped Kuwait
(B) G = Gross Wt % of GRH feed
N = Net wt % of GRH feed

TABLE III

VAPORIZER - GRH Tests
GRH Operating Temperature 1600–1650° F (Runs H-30–H-40)

Test Data
Feedstock: Monagas
Vaporizer Pressure PSIG: 600

| Run No. | Run Time Hrs. | Vap. Temp. % F (T-9) | GRH Temp. ° F Av. | Product Comp. Vol. % $CH_4$ | $C_2H_6$ | $H_2$ | Condensate** Wt. % of GRH Feed |
|---|---|---|---|---|---|---|---|
| H-30 | 18 | 802 | 1609 | 27.2 | 1.16 | 71.5 | 20.4 |
| H-31 | 5.5 | 800 | 1620 | 30.1 | 1.16 | 68.8 | 21.4 (G), 20.4 (N) |
| H-32-1 | 28 | 756 | 1621 | 32.5 | 1.11 | 66.3 | 21.9 (G)<br>19.3 (N) |
| H-32-2 | 5.0 | 811 | 1621 | 31.5 | 1.19 | 67.2 | Not Calculated |
| H-33 | 41.0 | 756 | 1616 | 36.7 | .63 | 62.6 | 22.2 (G)<br>19.8 (N) |
| H-34 | 15 | 738 | 1608 | 37.6 | .38 | 62.4 | 19.7 (G)<br>16.3 (N) |
| H-35-1 | 25) | 742 | 1623 | 38.6 | .54 | 60.8 | 21.1 (G) |

TABLE III-continued

VAPORIZER - GRH Tests
GRH Operating Temperature 1600–1650° F (Runs H-30–H-40)

Test Data
Feedstock: Monagas
Vaporizer Pressure PSIG: 600

| Run No. | Run Time Hrs. | Vap. Temp. % F (T-9) | GRH Temp. ° F Av. | $CH_4$ | Product Comp. Vol. % $C_2H_6$ | $H_2$ | Condensate** Wt. % of GRH Feed |
|---|---|---|---|---|---|---|---|
| | | | | | | | 17.9 (N) |
| H-35-2 | 6.0 ) 39.5 | 739 | 1625 | 37.7 | .5 | 61.7 | Not Calculated |
| H-35-3 | 4.5 ) | 797 | 1614 | 37.2 | .65 | 62.1 | 20.9 (G) |
| | | | | | | | 19.5 (N) |
| H-36-1 | 24 | 735 | 1612 | 33.5 | .67 | 65.9 | 17.8 (G) |
| | | | | | | | 14.1 (N) |
| H-36-2 | 12 | 743 | 1628 | 33.5 | .53 | 64.0 | 17.3 (G) |
| | | | | | | | 13.6 (N) |
| H-36-3 | 76 | 786 | 1625 | 34.5 | .54 | 64.9 | 19.1 (G) |
| | | | | | | | 17.2 (N) |
| H-37 | 22.5 | 802 | 1617 | 29.3 | 1.12 | 69.6 | 21 (G) |
| | | | | | | | 19.7 (N) |
| H-38 | 25 | 801 | 1626 | 29 | 1.01 | 69.5 | 21 (G) |
| | | | | | | | 19.8 (N) |
| H-39 | 50 | 802 | 1621 | 29.5 | 1.07 | 69.4 | 23.1 (G) |
| H-40 | 87 | 802 | 1620 | 29 | 1.15 | 69.8 | 20.5 (G) |
| | | | | | | | 19.0 (N) |

Notes:
**Condensate reflects Gross (G) and Net (N) formation and Benzene accounted for. Both are based wt. % of GRH feed.

From the foregoing Tables II and III, it is obvious that the elevated temperature operation of the gas recycle hydrogenator combined with the use of excess hydrogen produces a gasifier effluent that is substantially methane. The formation of ethane is effectively suppressed and carbon formation is also minimized.

Table IV sets forth the data from three experimental runs conducted to show that when the gasifier temperature is maintained above 1550° F, the ethane content in the effluent is less than 5 mole percent. The comparative runs set out in Table IV show that for a given feedstock, e.g. No. 2 fuel oil, when the GRH temperature dropped from 1555° F (Run F2G-08) to 1400° F (Runs F2G-09 and F2G-10) the ethane content of the effluent went from 4.6% by volume (mole percent) to over 15% by volume (mole percent).

TABLE IV

VAPORIZER - GRH Tests
GRH Operating Temperature 1400–1555° F

Test Data
Feedstock: No. 2 Fuel Oil
Vaporizer Pressure, PSIG: 350–600

| Run No. | Run Time Hrs. | Vap. Temp.° F (Mean Wall) | GRH Temp. ° F (Effluent) | GRH Press. PSIG | Product Composition Volume % $CH_4$ | $C_2H_6$ | $H_2$ | Condensate WT % of GRH Oil Feed |
|---|---|---|---|---|---|---|---|---|
| F2G-08 | 11 | 730 | 1555 | 600 | 36.3 | 4.6 | 56.4 | 21.4 |
| F2G-09 | 11 | 680 | 1400 | 350 | 25.1 | 15.6 | 54.8 | 27.0 |
| F2G-10 | 11 | 695 | 1400 | 400 | 26.5 | 15.9 | 52.5 | 26.8 |

Figure 4:
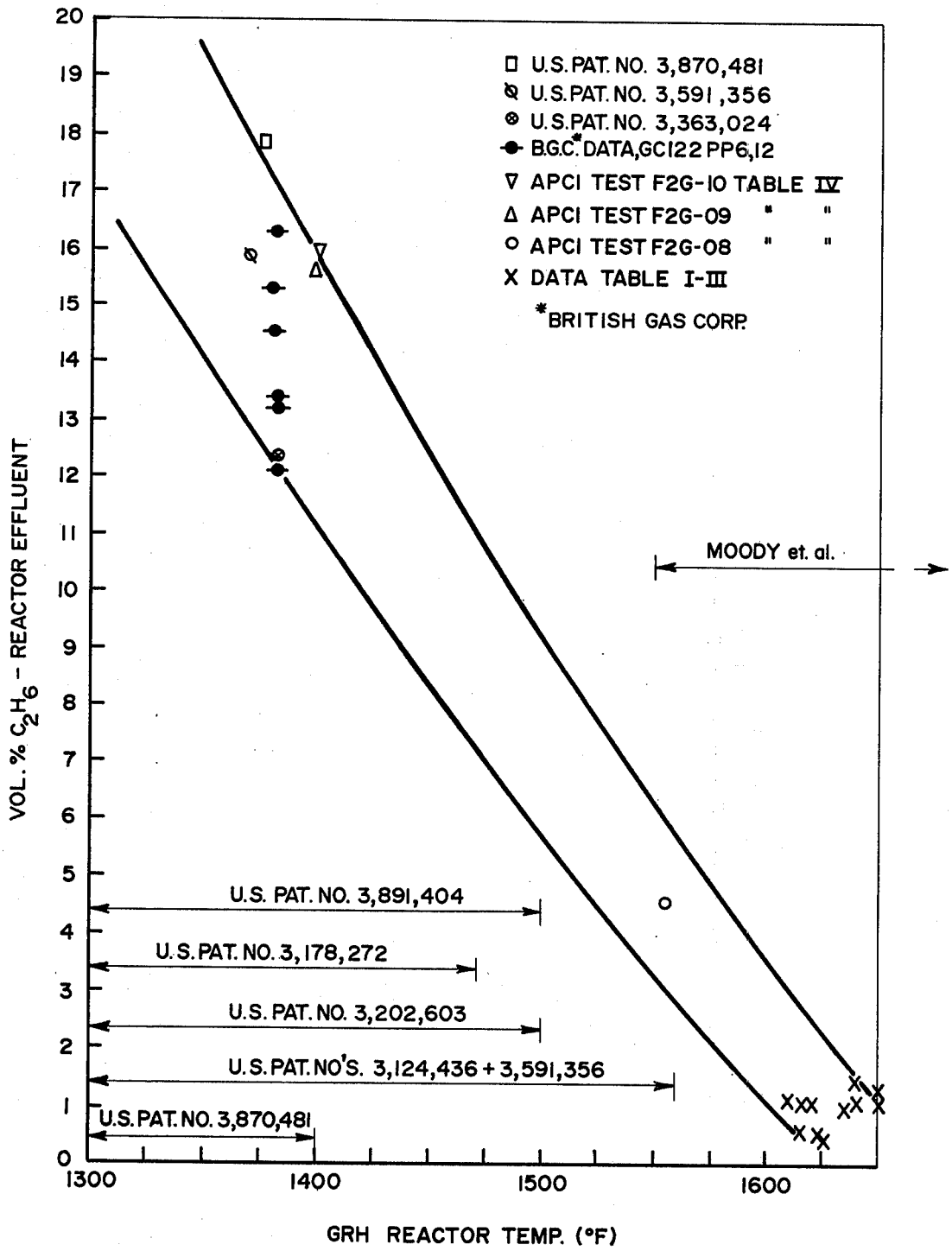
FIG. 4 is a plot of GRH Reactor Temperature against volume percent of ethane in the reactor effluent.

The data from Tables I-IV, along with data reported in U.S. Pat. No. 3,363,024, 3,591,356 and 3,870,481, together with test data reported by the British Gas Council (now British Gas Corporation) in a document entitled "The Hydrogenation of Oils to Gaseous Hydrocarbons" identified as Research Communication GC122 of the Gas Council, November 1965 is shown in the graph of Fig. 4 of the drawing wherein reactor temperature is plotted against the volume percent of ethane in the reactor effluent. FIG. 4 also shows the temperature limits of various prior art patents drawn to gasification of hydrocarbon feedstocks. Thus it is readily apparent from the data of Table IV and the plot of FIG. 4 that when the gasifier (reactor) is operated at temperatures in excess of 1550° F, the ethane content of the effluent is below 5 volume percent (mole percent).

Several tests have also been run using liquids derived from coal with similar results.

Lighter oils have also been run successfully; however, if lighter oils were available, the process could include a topping tower and a Catalytic Rich Gas unit to process the lighter fractions such as disclosed in U.S. Pat. No. 3,870,481. This would reduce the investment in the hydrogen producing area because of the reduced size of the partial oxidation system and oxygen plants.

The process of this invention can be used for the production of hydrogen, carbon monoxide, or hydrogen and carbon monoxide rather than for the production of SNG. Currently the major portion of the hydrogen, carbon monixide, or hydrogen and carbon monoxide produced today is by the catalytic steam reforming of natural gas. These products can also be produced by partial oxidation of heavier hydrocarbon feedstocks with oxygen and steam in a partial oxidation gasifier. Where natural gas is in short supply, heavier hydrocarbon feedstocks will have to be utilized for producing hydrogen or hydrogen and carbon monoxide. Partial oxidation of heavier feedstocks in substantially more expensive than steam reforming natural gas. The present invention can be adapted to produce hydrogen, carbon monoxide, or hydrogen and carbon monoxide from heavier hydrocarbon feedstocks without the use of a partial oxidation gasifier. The method of the present invention for producing hydrogen from a heavy hydrocarbon feedstock is utilized by gasifying the feedstock in the one stage gasification reactor to produce an effluent which is purified to give a product stream of gases that are essentially methane and hydrogen. This product stream is then mixed with steam and catalytically reformed to carbon monoxide and hydrogen in a steam reformer using this well known technology. A relatively pure stream of hydrogen can be produced by further reacting the carbon monoxide with steam over a bed of shift catalysts while maintaining different operating conditions and then purging this stream of the carbon dioxide formed. Part of this hydrogen product can be recycled back to the one stage gasification reactor, thus avoiding the use of partial oxidation while gasifying a heavy hydrocarbon feedstock.

If carbon monoxide is desired, the gas from the reformer is not shifted but is separated by well-known technology into its components and a portion of the hydrogen is recycled.

It is within the scope of the invention to utilize mixed feedstocks such as mixtures of different crude oil fractions, crude oil and coal derived liquids and the like.

Having thus described our invention, what we desire to be protected by Letters Patent of the United States is set forth in the appended claims.

We claim:

1. A method of producing a pipeline gas having a heating value of about 1,000 BTU/SCF from a hydrocarbon feedstock selected from the group consisting of crude oil, bitumen from tar sands, shale oil, liquid volatiles resulting from coking of coal, liquefied coal resulting from solvating coal with a solvent and hydrogen, aromatic hydrocarbons, naphtha, gas oils, crude oil distillates, and crude oil residues and mixtures thereof comprising the steps of:

vaporizing the hydrocarbon feedstock preheated to about 700° F in the presence of hydrogen at a temperature in excess of 750° F to produce a feedstream of hydrocarbon feedstock vapors and excess hydrogen;

injecting said feedstream into an adiabatic gasification vessel maintained at a pressure in excess of 75 psig and a temperature in excess of 1,550° F wherein the hydrocarbon feedstock vapors are gasified to form essentially methane and aromatic compounds, together with less than 5 mole percent ethane and with minor amounts of ethylene, propane, propylene and hydrogen sulfide in an effluent containing excess hydrogen;

cooling the effluent to recover waste heat and condensing a major portion of the aromatic fraction of said gasifier effluent;

separating out said condensed aromatic fraction from said effluent;

removing non-condensible residual aromatics and hydrogen sulfide from said effluent in a purification zone;

separating the hydrogen from the methane and other light hydrocarbons in the effluent to produce a product gas consisting essentially of methane;

returning the hydrogen separated from the effluent to the vaporization and gasification units of the process; and discharging said product gas into a product receiving device.

2. A method according to claim 1 wherein the aromatics separated from said gasifier effluent are returned and injected into said gasifier and said vaporizer.

3. A method according to claim 1 wherein said hydrogen sulfide is treated to produce elemental sulfur.

4. A method according to claim 1 wherein said hydrocarbon feedstock is partially vaporized in a vaporization vessel which contains a pool of the residual hydrocarbon feedstock from which said residual feedstock is withdrawn and used to produce hydrogen for injection into said vaporizer.

5. A method according to claim 1 wherein said hydrocarbon feedstock is selected from the group consisting of crude oil and crude oil fractions.

6. A method according to claim 1 wherein said hydrocarbon feedstock is liquefied coal resulting from solvating coal with solvent and hydrogen.

7. A method according to claim 1 wherein said hydrocarbon feedstock is bitumen from tar sands.

8. A method according to claim 1 wherein said hydrocarbon feedstock is shale oil.

9. A method or producing a pipeline gas having a heating value of about 1,000 BTU/SCF from a hydrocarbon feedstock selected from the group consisting of crude oil, bitumen from tar sands, shale oil, liquid volatiles resulting from coking of coal, liquefied coal resulting from solvating coal with a solvent and hydrogen, aromatic hydrocarbons, naphtha, gas oils, crude oil distillates, crude oil residues and mixtures thereof comprising the steps of:

vaporizing the hydrocarbon feedstock preheated to about 700° F in the presence of hydrogen at a temperature in excess of 750° F to produce a feedstream of hydrocarbon feedstock vapors and excess hydrogen;

injecting said feedstream into an adiabatic gasification vessel maintained at a pressure in excess of 75 psig and a temperature in excess of 1550° F wherein the hydrocarbon feedstock vapors are gasified to form essentially methane and aromatic compounds together with less than 5 mole percent ethane and with minor amounts of ethylene, propane, propylene and hydrogen sulfide in an effluent containing excess hydrogen;

cooling the effluent to recover waste heat and condensing a major portion of the aromatic fraction of said gasifier effluent;

separating out said condensed aromatic fraction from said effluent;

removing residual aromatics and hydrogen sulfide from said effluent in a purification zone;

revaporizing and recycling said residual aromatics and condensed aromatic fraction to said gasifier and said vaporizer;

separating the hydrogen from the methane and other light hydrocarbons in the effluent to produce a product gas consisting essentially of methane;

returning the hydrogen separated from the effluent to the vaporization and gasification units of the process; and discharging said product gas into a product receiving device.

10. A method of producing a pipeline gas having a heating value of about 1,000 BTU/SCF from a hydrocarbon feedstock selected from the group consisting of crude oil, bitumen from tar sands, shale oil, liquid volatiles resulting from coking of coal, liquefied coal resulting from solvating coal with a solvent and hydrogen, aromatic hydrocarbons, naphtha, gas oils, crdue oil distillates, crude oil residues and mixtures thereof comprising the steps of:

vaporizing the hydrocarbon feedstock preheated to about 700° F in the presence of hydrogen at a temperature in excess of 750° F in a vaporization vessel which contains a pool of the residual hydrocarbon feedstock to produce a feedstream of hydrocarbon feedstock vapors and excess hydrogen;

withdrawing residual feedstock from the vaporization vessel pool and using said residual feedstock to produce process hydrogen by the partial oxidation process;

injecting said feedstream into an adiabatic gasification vessel maintained at a pressure in excess of 75 psig and a temperature in excess of 1550° F wherein the hydrocarbon feedstock vapors are gasified to form essentially methane and aromatic compounds together with less than 5 mole percent ethane and with minor amounts of ethylene, propane, propylene and hydrogen sulfide in an effluent containing excess hydrogen;

cooling the effluent to recover waste heat and condensing a major portion of the aromatic fraction of said gasifier effluent, separating out said condensed aromatic fraction from said effluent and revaporizing and recycling said aromatic fraction to said gasifier and said vaporizer;

removing residual aromatics and hydrogen sulfide from said effluent in a purification zone;

separating the hydrogen from the methane and other light hydrocarbons in the effluent to produce a product gas consisting essentially of methane;

returning the hydrogen separated from the effluent to the vaporization and gasification units of the process; and discharging said product gas into a product receiving device.

11. A method of producing an effluent stream consisting essentially of methane and an aromatic fraction consisting essentially of benzene from a hydrocarbon feedstock selected from the group consisting of crude oil, crude oil fractions, bitumen from tar sands, shale oil, liquids resulting from the pyrolysis of coal, liquefied coal produced from solvating coal with a solvent and hydrogen, and mixtures thereof comprising the steps of:

vaporizing the feedstock by heating the feedstock in the presence of hydrogen at a temperature below 1000° F and at a pressure greater than 75 psig; and rapidly heating the feedstock vapors and hydrogen to a temperature in excess of 1550° F and at a pressure greater than 75 psig and maintaining said feedstock at a temperature and pressure for a time sufficient to cause said feedstock vapors to react with said hydrogen to form an effluent consisting essentially of methane, an aromatic fraction containing primarily benzene, unreacted hydrogen, together with less than 5 mole percent ethane and minor amounts of ethylene, propane, propylene and hydrogen sulfide.

12. A method according to claim 11 wherein said effluent is cooled to recover heat thus condensing a major portion of the aromatic fraction; and said condensed aromatics are removed from said effluent.

13. A method according to claim 12 wherein the uncondensed aromatic fraction together with the hydrogen sulfide is removed in a purification zone.

14. A method according to claim 13 wherein said hydrogen is separated from said effluent and recycled for use in said vaporization or said heating steps.

15. A method according to claim 13 wherein the separated aromatic fractions are returned to the vaporization step for addition to the feedstock and hydrogen fed to the heating step.

16. A method according to claim 11 wherein said effluent is cooled to recover heat thus condensing a portion of the aromatic fraction; and said effluent is further processed by:

removing said condensed aromatic portion from said effluent;

passing said effluent through a purification zone to remove said hydrogen sulfide and residual uncondensed aromatic fractions thus producing a product stream consisting essentially of methane and hydrogen; and introducing said product stream to a steam reformer wherein said methane is catalytically reformed in the presence of steam thus producing a product gas consisting essentially of hydrogen, carbon monoxide and carbon dioxide.

17. A method according to claim 16 wherein said product gas is introduced into a shift reactor for conversion of the carbon monoxide to hydrogen and carbon dioxide; and said carbon dioxide is removed from said product gas to produce an end product consisting of substantially pure hydrogen.

18. A method of producing substantially pure hydrogen from a hydrocarbon feedstock selected from the group consisting of crude oil, crude oil fractions, bitumen from tar sands, shale oil, liquids resulting from the pyrolysis of coal, liquefied coal produced from solvating coal with a solvent and hydrogen and mixtures thereof comprising the steps of:

vaporizing the feedstock by heating the feedstock in the presence of hydrogen at a temperature below 1000° F and at a pressure greater than 75 psig;

rapidly heating the feedstock vapors and hydrogen to a temperature in excess of 1550° F and at a pressure greater than 75 psig and maintaining said feedstock vapors at temperature and pressure for a time sufficient to cause said feedstock vapors to react with said hydrogen to form an effluent consisting essentially of methane, an aromatic fraction containing primarily benzene, unreacted hydrogen together with less than 5 mole percent ethane and minor amounts of ethylene, propane, propylene and hydrogen sulfide;

cooling said effluent to recover heat thus condensing and removing a major portion of the aromatic fraction from said effluent;

passing said effluent through a purification zone to remove said hydrogen sulfide and residual uncondensed aromatic fractions thus producing a product stream consisting essentially of methane and hydrogen;

introducing said methane and hydrogen product stream into a steam reformer wherein said methane is catalytically reformed in the presence of steam to produce a gas consisting essentially of hydrogen, carbon monoxide and carbon dioxide;

passing said gas through a shift reactor to convert the carbon monoxide to carbon dioxide and hydrogen;

removing said carbon dioxide from said gas thus producing a gas as an end product which is substantially pure hydrogen.

* * * * *

UNITED STATES PATENT AND TRADEMARK OFFICE

CERTIFICATE OF CORRECTION

PATENT NO. : 4,025,318

DATED : May 24, 1977

INVENTOR(S) : Burton E. Moody and John E. Schuster

It is certified that error appears in the above-identified patent and that said Letters Patent are hereby corrected as shown below:

Column 2, Line 6
Delete "temperture" and substitute therefor -- temperature --

Column 2, Line 38
Delete "primarlily" and substitute therefor -- primarily --

Column 4, Line 13
After "producing", insert -- a product --

Column 4, Line 37
Delete "hyrodcarbons" and substitute therefor
-- hydrocarbons --

Column 5, Line 5
Delete "curde" and substitute therefor -- crude --

Column 5, Line 7
Delete "hydorcarbon" and substitute therefor -- hydrocarbon --

Column 5, Line 15
Delete "gaisfier" and substitute therefor -- gasifier --

Column 5, Line 20
Delete "rapidily" and substitute therefor -- rapidly --

Column 5, Line 26
Delete "rodgen" and substitute therefor -- drogen --

Column 5, Line 32
After "into", insert -- the --

UNITED STATES PATENT AND TRADEMARK OFFICE

CERTIFICATE OF CORRECTION

PATENT NO. : 4,025,318

DATED : May 24, 1977

INVENTOR(S) : Burton E. Moody and John E. Schuster

It is certified that error appears in the above-identified patent and that said Letters Patent are hereby corrected as shown below:

Column 5, Line 55
Delete "absorption" and substitute therefor -- adsorption --

Column 5, Line 66
Delete "hydorgen" and substitute therefor -- hydrogen --

Column 6, Line 18
Delete "revovery" and substitute therefor -- recovery --

Column 6, Line 45
After "Midway", insert -- Coal --

Column 7, Line 18
Delete "63" and substitute therefor -- 62 --

Column 7, Line 21
Delete "aboout" and substitute therefor -- about --

Column 7, Line 41
Delete "porximately" and substitute therefor -- proximately -

Column 7, Line 44
Delete "inthe" and substitute therefor -- in the --

Column 8, Line 52
Delete "112" and substitute therefor -- 122 --

Column 9, Line 25
After "and", insert -- 0.2% --

Column 10, Line 6
Delete "$H_{20}$" and substitute therefor -- $H_2O$ --

UNITED STATES PATENT AND TRADEMARK OFFICE

CERTIFICATE OF CORRECTION

PATENT NO. : 4,025,318

DATED : May 24, 1977

INVENTOR(S) : Burton E. Moody and John E. Schuster

It is certified that error appears in the above-identified patent and that said Letters Patent are hereby corrected as shown below:

Column 10, Line 28
Delete "thanthe" and substitute therefor -- than the --

Column 10, Line 45
Delete "3,870,841" and substitute therefor -- 3,870,481 --

Column 12, Line 15
Delete "thee" and substitute therefor -- these --

Column 16, Line 23
Delete "or" and substitute therefor -- of --

Column 17, Line 2
Delete "crdue" and substitute therefor -- crude --

Signed and Sealed this

*Eighth* Day of *November 197*

[SEAL]

*Attest:*

RUTH C. MASON
*Attesting Officer*

LUTRELLE F. PARKER
*Acting Commissioner of Patents and Trademar*